US006406202B1

(12) United States Patent
Unno et al.

(10) Patent No.: US 6,406,202 B1
(45) Date of Patent: Jun. 18, 2002

(54) TAPE CARTRIDGE-HOLDING MECHANISM AND TAPE PRINTING APPARATUS INCLUDING THE SAME

(75) Inventors: Teruhiko Unno; Akira Hashimoto, both of Shiojiri; Takuya Suetani, Toda; Tomoki Nakamura, Fumabashi; Nobuyuki Horii, Kawasaki, all of (JP)

(73) Assignees: Seiko Epson Corporation; King Jim Co., Ltd., both of Tokyo (JP)

( * ) Notice: Subject to any disclaimer, the term of this patent is extended or adjusted under 35 U.S.C. 154(b) by 0 days.

(21) Appl. No.: 09/600,969

(22) PCT Filed: Nov. 25, 1999

(86) PCT No.: PCT/JP99/06572

§ 371 (c)(1),
(2), (4) Date: Jul. 25, 2000

(87) PCT Pub. No.: WO00/32401

PCT Pub. Date: Jun. 8, 2000

(30) Foreign Application Priority Data

Nov. 27, 1998 (JP) ..... 10-337554

(51) Int. Cl.[7] ..... B41J 35/22

(52) U.S. Cl. ..... 400/613; 400/194; 400/196; 400/207; 400/208

(58) Field of Search ..... 400/196, 194, 400/207, 208, 242, 613, 609, 246, 248.1, 206

(56) References Cited

U.S. PATENT DOCUMENTS 5,267,802 A * 12/1993 Parnell et al. ..... 400/208
5,538,351 A * 7/1996 Miyano ..... 400/206
5,739,839 A * 4/1998 Iwai et al. ..... 347/214
5,777,652 A * 7/1998 Takeuchi ..... 347/171
5,951,176 A * 9/1999 Ueda et al. ..... 400/206
6,168,328 B1 * 1/2001 Ueda et al. ..... 400/206

FOREIGN PATENT DOCUMENTS

JP 703089 A1 3/1996
JP 745487 A1 12/1996

* cited by examiner

*Primary Examiner*—Andrew H. Hirshfeld
*Assistant Examiner*—Kevin D. Williams
(74) *Attorney, Agent, or Firm*—Hogan & Hartson, L.L.P.

(57) ABSTRACT

There are provided a tape cartridge-holding mechanism which is capable of reliably and immovably holding a tape cartridge in a cartridge compartment without spoiling the ease of mounting and removal of the tape cartridge, and a tape printing apparatus including the tape cartridge-holding mechanism. The tape cartridge-holding mechanism comprises a lid for opening/closing a cartridge compartment, at least one pair of left and right holding nails for engaging with a tape cartridge mounted in the cartridge compartment and thereby sandwiching the tape cartridge such that the holding nails press the tape cartridge against a bottom surface of the cartridge compartment, and an urging mechanism arranged in contact with at least one of the pair of holding nails, for urging the holding nail in a direction of sandwiching the tape cartridge as closing operation of the lid is carried out.

4 Claims, 6 Drawing Sheets

TAPE CARTRIDGE-HOLDING MECHANISM AND TAPE PRINTING APPARATUS INCLUDING THE SAME

TECHNICAL FIELD

This invention relates to a tape cartridge-holding mechanism for immovably holding a tape cartridge mounted in a cartridge compartment, and a tape printing apparatus including the tape cartridge-holding mechanism.

BACKGROUND ART

Conventionally, in a tape printing apparatus of this kind, a printing tape is rolled out from a tape cartridge mounted in the apparatus, and printing is carried out on the printing tape rolled out. Therefore, the tape printing apparatus has a lidded cartridge compartment formed as a recess for receiving a tape cartridge therein, and a print head arranged in the cartridge compartment. Further, as shown in FIG. 6, the cartridge compartment 60 has a compartment casing 61 having a pair of left and right resilient holding nails 62, 62 integrally formed therewith in an erected manner. When a tape cartridge 63 is mounted in the cartridge compartment 60, the pair of holding nails 62, 62 engage with respective sloping faces 64a of recesses 64 of the tape cartridge 63 to immovably sandwich the tape cartridge therebetween such that the holding nails 62 press the tape cartridge 63 against a bottom surface 61a of the compartment casing 61. Thus, the tape cartridge 63 is prevented from becoming shaky or being lifted in the cartridge compartment 60, which ensures stable feed of the printing tape and stable printing on the same.

The tape printing apparatus in which the tape cartridge is held in the cartridge compartment by the conventional holding nails suffers from a problem that if the spring force of each holding nail is set to be small, the tape cartridge is lifted when the printing tape is rolled out, which causes the tape to be advanced in an inclined state or jammed. Particularly when the holding nails are made of resin and integrally formed with the compartment casing, long-term use of the apparatus can permanently set the holding nails in fatigue, thereby causing a decrease in their spring force. On the other hand, if the spring force of each holding nail is set to be large, a large force is required to mount and remove a tape cartridge, which makes the mounting/removing of the tape cartridge troublesome.

Therefore, it is an object of the present invention to provide a tape cartridge-holding mechanism which is capable of reliably and immovably holding a tape cartridge in a cartridge compartment without spoiling the ease of mounting and removal of the tape cartridge, and a tape printing apparatus including the tape cartridge-holding mechanism.

DISCLOSURE OF INVENTION

A tape cartridge-holding mechanism according to claim 1 is characterized by comprising a lid for opening/closing a cartridge compartment, at least one pair of left and right holding nails for engaging with a tape cartridge mounted in the cartridge compartment and thereby sandwiching the tape cartridge therebetween such that the holding nails press the tape cartridge against a bottom surface of the cartridge compartment, and an urging mechanism arranged in contact with at least one of the pair of holding nails, for urging the holding nail in a direction of sandwiching the tape cartridge as closing operation of the lid is carried out.

According to this construction, when the lid is closed after a tape cartridge having been mounted in the cartridge compartment, the urging mechanism urges the holding nails in the direction of sandwiching the tape cartridge. As a result, in a state of the lid being closed, the holding nails sandwich the tape cartridge therebetween such that they firmly press the tape cartridge against the bottom surface of the cartridge compartment. On the other hand, in a state of the lid being open, the urging of the holding nails by the urging mechanism is canceled, so that it is possible to mount or remove the tape cartridge in or from the cartridge compartment easily by a small force.

Preferably, the urging mechanism includes an urging member mounted on a side wall of the cartridge compartment such that the urging member can advance and withdraw, for advancing to press on the holding nail, and an operating piece extending from the lid, and at least one of engaging portions of the urging member and the operating piece is formed with a cam surface for converting closing motion of the lid to advancing motion of the urging member.

According to this construction, since cam action of the cam surface between the operating piece and the urging member is utilized, it is possible to press on the holding nail by the mechanism having a simple construction.

Preferably, a resilient element is interposed between the holding nail and the urging member.

According to this construction, the holding nail can be urged stably by the resilient element, which makes it possible to stably hold a tape cartridge in spite of an error or tolerance of width of the tape cartridge in the direction of being sandwiched.

A tape printing apparatus according to claim 4 is characterized by including a tape cartridge-holding mechanism according to claim 1, 2, or 3.

According to this construction, since the tape printing apparatus is capable of immovably holding a tape cartridge in the cartridge compartment, it is possible to effectively prevent a tape from being advanced in an inclined state or jammed. Further, it is possible to mount and remove the tape cartridge by a small force.

BEST MODE OF CARRYING OUT THE INVENTION

The invention will now be described in detail with reference to the drawings showing a tape printing apparatus to which is applied a tape cartridge-holding mechanism according to an embodiment thereof. The tape printing apparatus is capable of printing desired characters and figures on a strip of printing tape and cutting off a printed portion of the printing tape to a predetermined length. The cut-off piece of the printing tape is used as a label to be affixed to a document file or the like. That is, the tape printing apparatus makes a label printed with characters and figures from a strip of plain printing tape. In this case, the plain printing tape and an ink ribbon as consumable articles are provided in a state contained in a tape cartridge.

Figure 1:
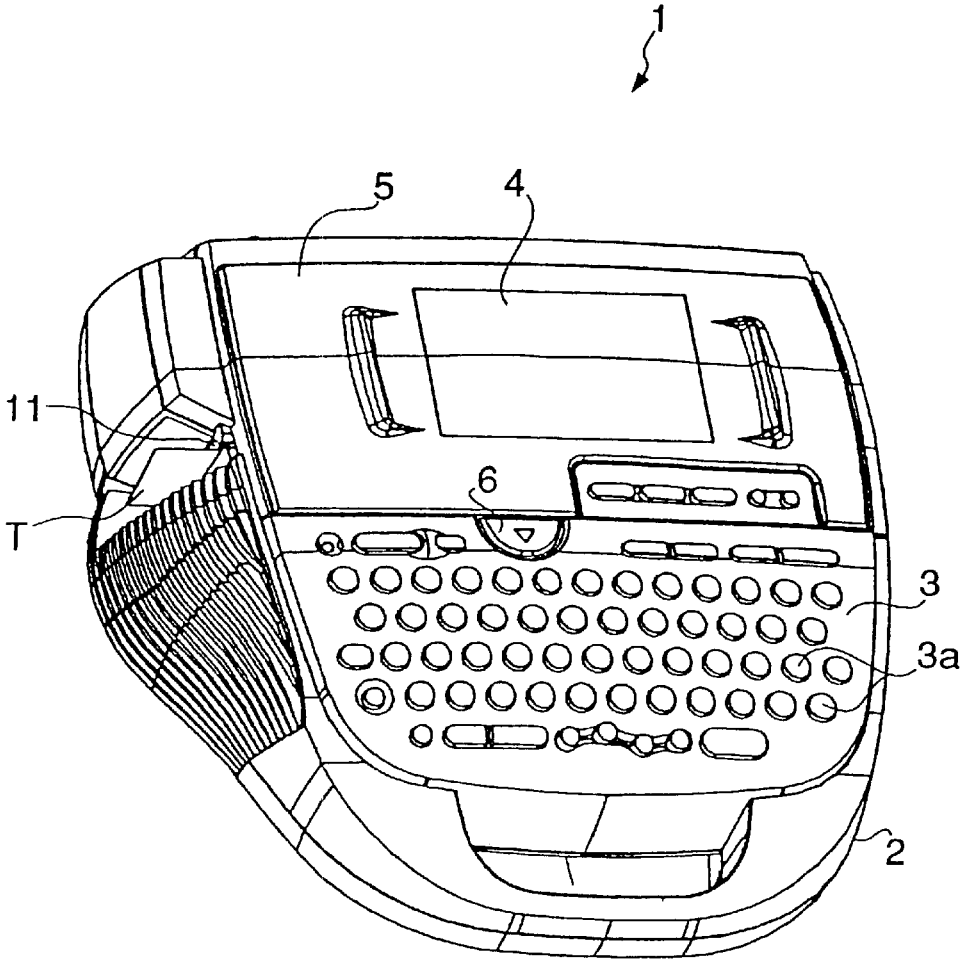
FIG. 1 is a perspective view of an appearance of a tape printing apparatus according to an embodiment of the invention.
Figure 2:
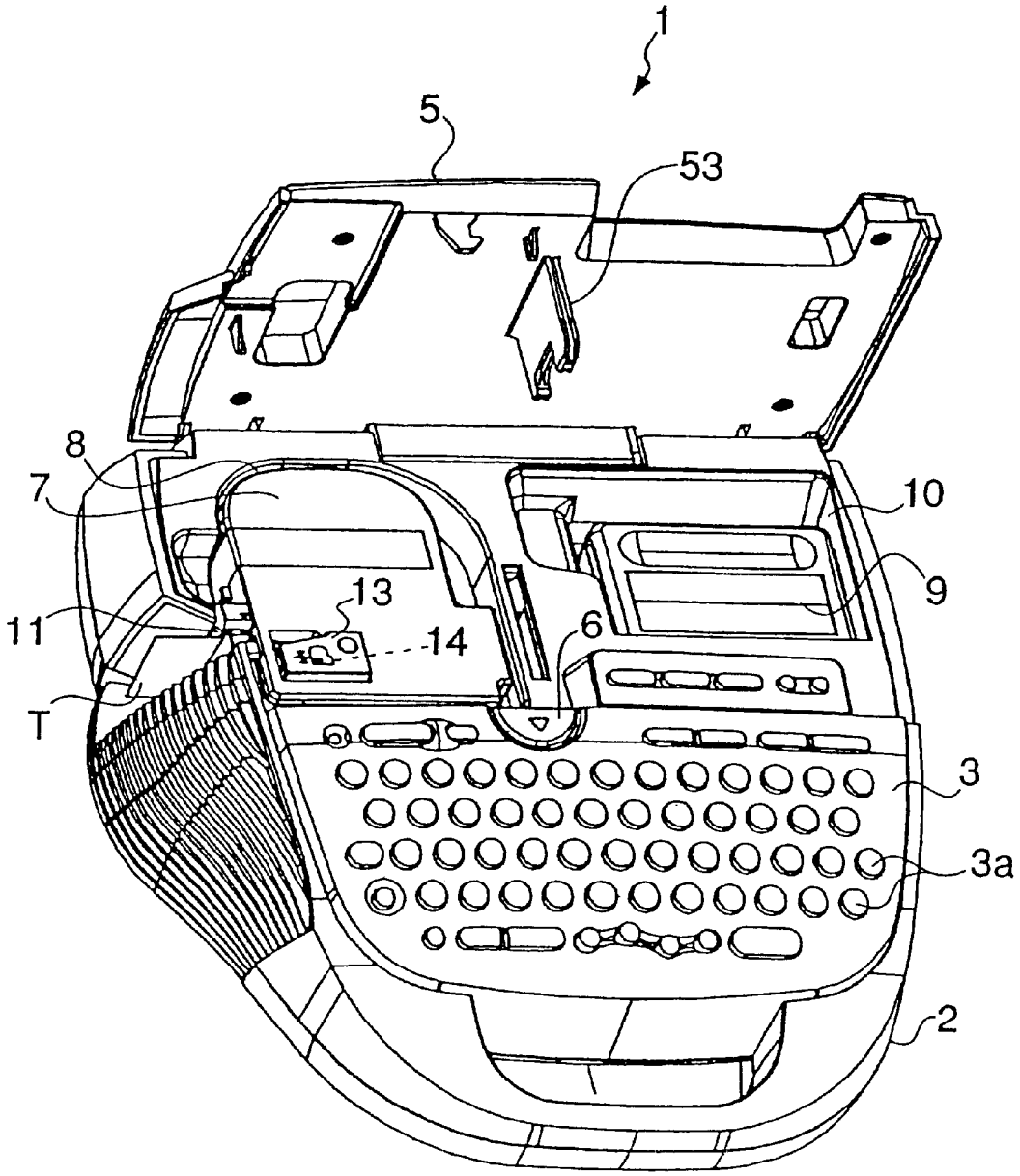
FIG. 2 is a perspective view of the tape printing apparatus according to the embodiment in a state of a lid thereof being open.

Referring first to FIGS. 1 and 2, the tape printing apparatus 1 has an apparatus casing 2 comprised of upper and lower divisional portions, and a handle formed at the front thereof. A key entry block 3 comprised of various kinds of keys 3*a* is arranged in the front portion of the tape printing apparatus 1, while a lid 5 incorporating a liquid crystal display 4 is arranged in the rear portion of the same. At a location close to the mid portion of the lid 5, there is arranged a lid-opening button 6 for opening the lid 5. Further, in the left-side portion under the lid 5 in formed a cartridge compartment 8 for mounting a tape cartridge 7 therein, and in the right-side portion under the lid 5 is a memory compartment 10 for mounting a memory pack (font-storing memory and expansion memory) 9 therein.

The apparatus casing 2 has a left side portion thereof formed with a tape exit 11 for permitting the cartridge compartment 8 and the outside of the apparatus 1 to communicate with each other, and a tape cutter, not shown, for cutting off a dispensed portion of the tape T faces the tape exit 11. The tape cutter is linked to an automatic cutting mechanism, not shown, and operated by the automatic cutting mechanism to perform a cutting operation.

In the cartridge compartment 8, there extend upright a print head 14 covered with a head cover 13, a platen shaft (not shown) opposed to the print head 14, a take-up reel (not shown) for taking up used part of the ink ribbon, and a guide projection 15 (see FIG. 3) for guiding the tape cartridge 7 when it is mounted. A platen, not shown, is incorporated in the tape cartridge 7.

When a label is produced by using the tape printing apparatus 1, first, the lid-opening button 6 is depressed to cause the lid 5 to pop up, and then the lid 5 is manually fully opened. Then, the tape cartridge 7 is pushed into the cartridge compartment 8 for mounting. When the tape cartridge 7 is mounted, the lid 5 is closed to place the tape printing apparatus 1 in a printing wait state. Then, input and edit are carried out as desired by operating the key entry block 3 while viewing the liquid crystal display 4. When the desired input can be confirmed on the liquid crystal display 4, the key entry block 3 is further operated to issue a print command.

When the print command is issued, the printing tape T and the ink ribbon contained in the tape cartridge 7 start to run simultaneously, and the desired characters and figures are printed on the printing tape T by the print head 14. As the printing operation proceeds, a used portion of the ink ribbon is taken up in the tape cartridge 7, while a printed portion of the printing tape T is sent out of the tape exit 11. When the printing is completed, the printing tape T is further fed by an amount corresponding to a margin, and then the running of the printing tape T and the ink ribbon is stopped. Subsequently, the automatic cutting mechanism operates to cause the cutting operation of the tape cutter, whereby the printing tape T is cut off.

Figure 3:
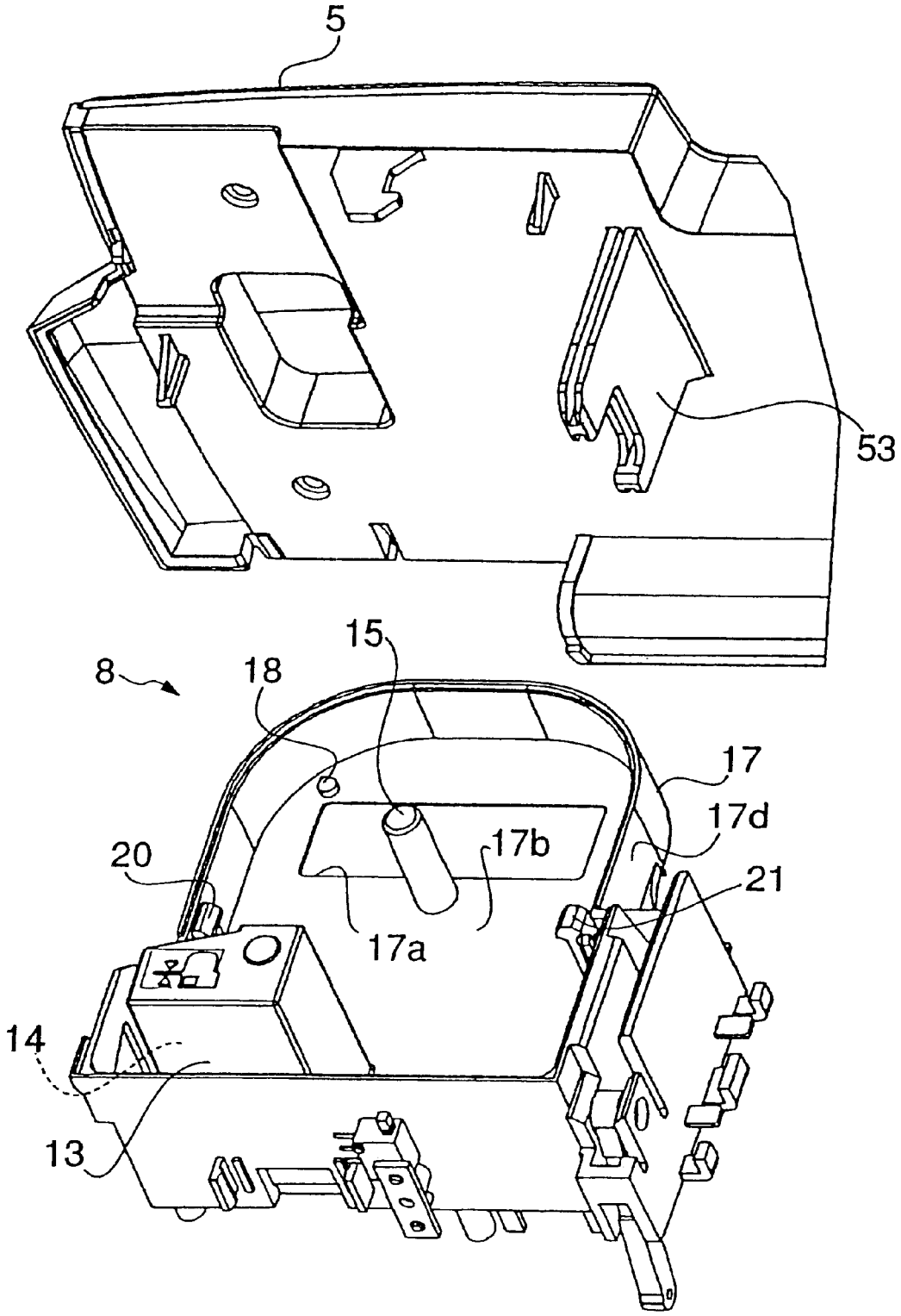
FIG. 3 is a perspective view of a cartridge compartment (compartment casing) of the tape printing apparatus and component parts associated with the cartridge compartment.
Figure 4:
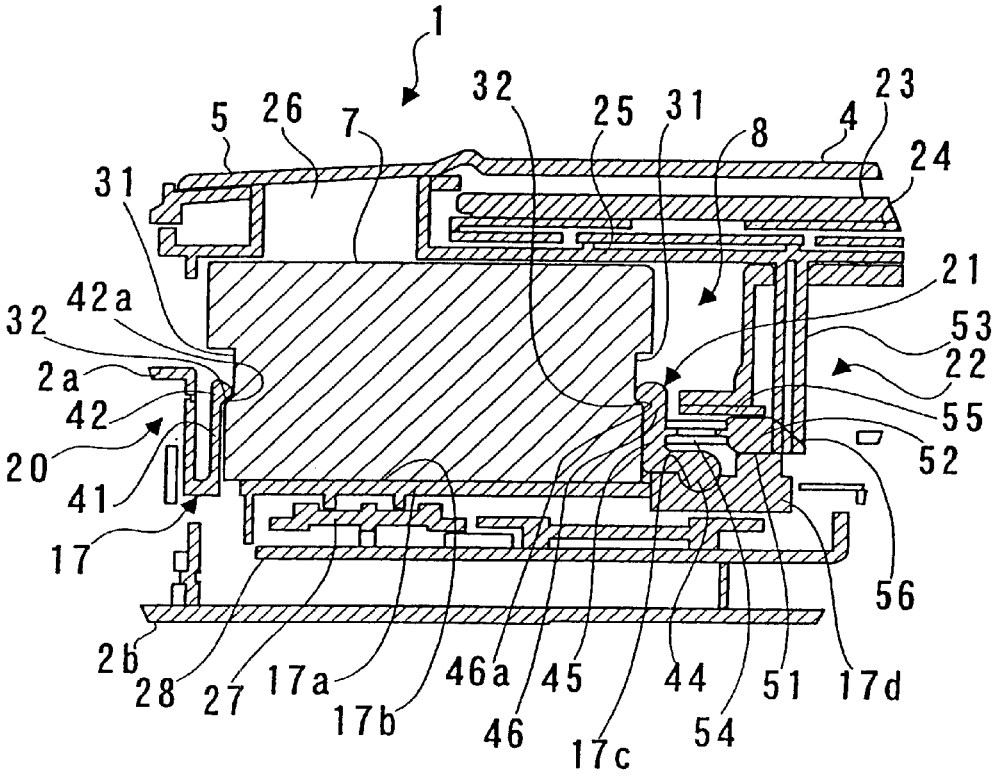
FIG. 4 is a cross-sectional view of the cartridge compartment (compartment casing) of the tape printing apparatus and component parts associated with the cartridge compartment.
Figure 5:
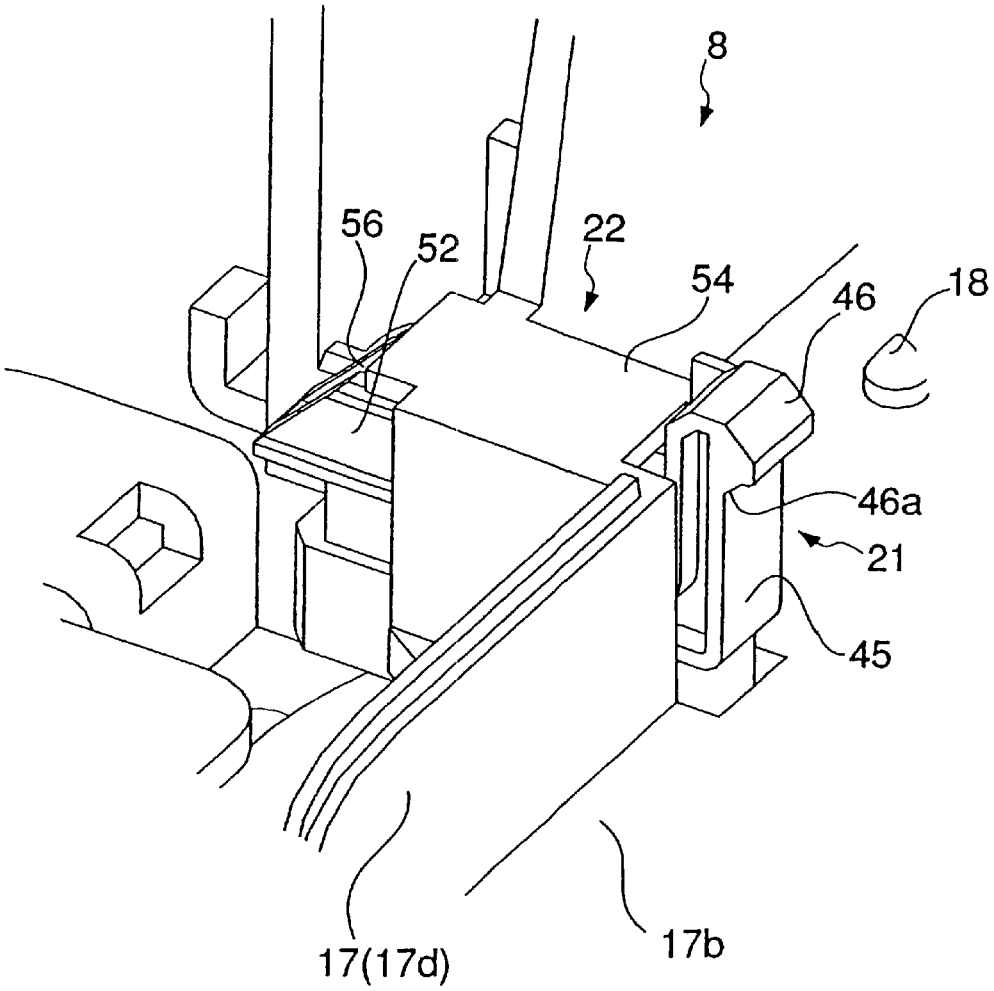
FIG. 5 is an enlarged perspective view of a holding nail and an urging mechanism as well as component parts associated therewith.
Figure 6:
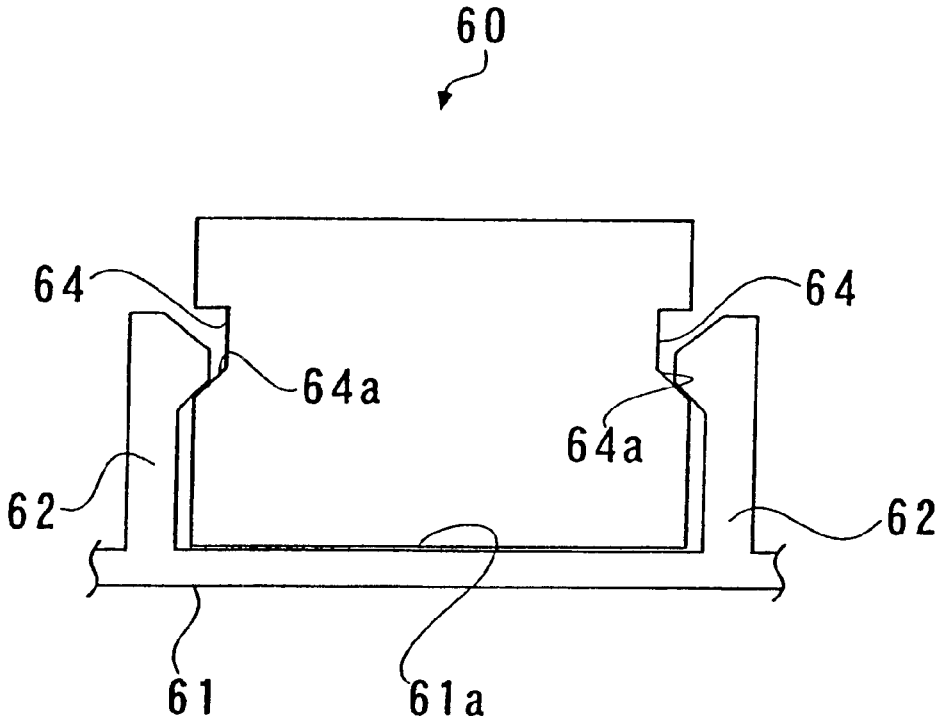
FIG. 6 PRIOR ART
FIG. 6 is a partial cross-sectional view of a conventional cartridge compartment.

As shown in FIGS. 3 and 4, the inner surface of a compartment casing 17 defining the cartridge compartment 8 is formed to have a shape generally complementary to the shape of the tape cartridge 7. The compartment casing 17 includes a bottom plate 17*a* having the head cover 13 and the guide projection 15 both integrally formed therewith such that they extend upright therefrom as well as a plurality of positioning projections 18 each integrally formed therewith. Further, in the compartment casing 17, there are arranged a stationary holding nail 20 and a movable holding nail 21 on respective opposite left and right sides. When the tape cartridge 7 is mounted, the two holding nails 20, 21 sandwich the tape cartridge 7 such that they press the same downward. Thus, the tape cartridge 7 mounted in the cartridge casing (cartridge compartment 8) 17 is immovably held, and the printing tape T is rolled out from the tape cartridge 7 in this state, for printing.

In FIG. 4, reference numerals 23 and 24 designate a liquid crystal panel of the liquid crystal display 4 and a circuit board of the same, respectively, and reference numeral 25 designates a lower casing of the lid 5 housing the liquid crystal panel and the circuit board and formed with an operating piece 53 referred to hereinafter. Further, reference numeral 26 designates a window, reference numerals 2*a* and 2*b* designate upper and lower casings of the apparatus casing 2, respectively, and reference numerals 27 and 28 designate a tape feed mechanism for feeding the printing tape T and the ink ribbon and a base frame for supporting the tape feed mechanism 27, respectively.

The tape cartridge 7 has opposite side faces thereof formed with a pair of recesses 31, 31 for engagement with the respective holding nails 20, 21 (see FIG. 4). Each recess 31 has a lower side thereof formed as a sloped portion 32 which slopes downward and outward. Each of the holding nails 20, 21 is brought into contact with a corresponding one of the sloped portions 32 to press on the same. As a result, a component of the pressing force acts to press down the tape cartridge 7 against the bottom surface 17*b* of the compartment casing 17.

The stationary holding nail 20 on the side of the head cover 13 is integrally formed with the apparatus casing 17, and comprised of a resilient arm portion 41 and a nail portion 42 formed at an end of the arm portion 41. The nail portion 42 has a lower portion thereof formed with a sloping face 42*a* having a complementary shape to the sloped portion 32 of the recess 31, and the sloping face 42*a* of the nail portion 42 presses on the sloped portion 32 of the recess 31 to thereby press down the tape cartridge 7.

The movable holding nail 21 arranged away from the head cover 13 is formed to be a unitary member which has a pivotal base portion 44 pivotally seated on a semicircular seat 17*c* of the compartment casing 17, an L arm portion 45 having an L shape and extending from the pivotal base portion 44, and a nail portion 46 formed at an end of the L arm portion 45. Similarly to the nail portion 42, the nail portion 46 is formed with a sloping face 46*a*. Arranged at the rear of the movable holding nail 21 is an urging mechanism 22 for urging the movable holding nail 21 toward the tape cartridge 7.

The urging mechanism 22 is comprised of an urging member 52 inserted through a guide through hole 51 formed through a side wall 17*d* of the compartment casing 17, such that the urging member 52 can advance and withdraw in the guide through hole 51, the operating piece 53 extending perpendicularly from an underside surface of the lid 5, a coiled spring 54 interposed between the urging member 52 and the movable holding nail 21, and a cover 55 for covering the urging member 52 and the coiled spring 54. A rearward end portion of the urging member 52 for engagement (or contact) with a lower end of the operating piece 53 is formed with a sloping cam surface 56. When the lid 5 is closed, the urging member 52 is advanced toward the movable holding nail 21 by cam action between the lower end of the operating piece 53 and the sloping cam surface 56. The coiled spring 54 is interposed between a forward end of the urging member 52 and a rear surface of the movable holding nail 21. When the urging member 52 moves forward, the coiled spring 54 is caused to contract for urging the movable holding nail 21 toward the tape cartridge 7. On the other hand, when the lid 5 is opened, the operating piece 53 moves away from the urging member 52, whereby the urging member 52 is caused to withdraw by the coiled spring 54. It should be noted that at the rear of the urging member 52, there is arranged a stopper, not shown, for limiting a withdrawn position of the urging member 52.

As described above, when the lid 5 is closed in a state of the tape cartridge 7 being mounted in the cartridge compartment 8, the movable holding nail 21 is pressed by the urging mechanism 22, whereby the tape cartridge 7 is held tightly in a manner sandwiched between the movable holding nail 21 and the stationary holding nail 20 and pressed down firmly against the bottom surface 17*b* of the compartment casing 17. Thus, the tape cartridge 7 is immovably held in the cartridge compartment 8. In the present embodiment, especially by using a holding nail arranged away from the head cover 13 as the movable holding nail 21 urged by the urging mechanism 22, it is possible to effectively prevent the tape cartridge 7 from being lifted. Further, when the lid 5 is opened, the urging of the movable holding nail 21 by the urging mechanism 22 is canceled, whereby the force sandwiching the tape cartridge 7 is reduced. Thus, it is possible to mount and remove the tape cartridge 7 easily by a small force as well as prevent the mounted tape cartridge 7 from becoming shaky. Therefore, it is possible to immovably hold the tape cartridge 7 in the cartridge compartment 8 without spoiling the ease of mounting and removal of the same.

It should be noted that the number of the holding nails is not limited to two, but more than two holding nails may be used. Further, more than one movable holding nail may be employed. The movable holding nail which is pivotally movable may be replaced by a movable holding nail which is slidable. Moreover, a portion of a tape cartridge for engaging with a holding nail is not limited to a recess, but the portion may be a projection so long as it has a face on which a downward component of the pressing force acts when the holding nail is brought into contact with the portion.

INDUSTRIAL APPLICABILITY

As described above, according to the tape cartridge-holding mechanism of the invention, it is possible to utilize opening/closing operation of the lid to sandwich a tape cartridge tightly and press the same firmly against the bottom surface of the cartridge compartment when the lid is closed as well as to mount or remove a tape cartridge in or from the cartridge compartment by a small force when the lid is open. Therefore, the tape cartridge-holding mechanism is suitable for reliably and immovably holding a tape cartridge in the cartridge compartment without spoiling the ease of mounting and removing the tape cartridge.

Further, the tape printing apparatus of the invention is capable of immovably holding a tape cartridge in the cartridge compartment. Therefore it is suitable for effectively preventing a tape from being fed in an inclined state or jammed as well as to mount and remove the tape cartridge by a small force.

What is claimed is:

1. A tape cartridge-holding mechanism comprising:

a lid for, opening/closing at cartridge, compartment;

at least one pair of left and right holding nails for engaging with a tape cartridge mounted in said cartridge compartment and thereby sandwiching said tape cartridge therebetween such that said holding nails press said tape cartridge against a bottom surface of said cartridge compartment; and an urging mechanism arranged in contact with at least one of said pair of holding nails, for urging said holding nail in a direction of sandwiching said tape cartridge, said urging mechanism including means for converting closing motion of said lid to pressing motion on said holding nails in a direction of sandwiching said tape cartridge.

2. A tape cartridge-holding mechanism according to claim 1, wherein said means for converting includes an urging member mounted on a side wall of said cartridge compartment such that said urging member can advance and withdraw, for advancing to press on said holding nail, said urging member having an engaging portion, and an operating piece extending from said lid, said operating piece having an engaging portion, and wherein at least one of said engaging portions of said urging member and said operating piece is formed with a cam surface for converting closing motion of said lid to advancing motion of said urging member.

3. A tape cartridge-holding mechanism according to claim 2, wherein a resilient element is interposed between said holding nail and said urging member.

4. A tape printing apparatus comprising a tape cartridge-holding mechanism according to claim 1, 2, or 3.

* * * * *